US009744431B2

(12) United States Patent
Etallaz

(10) Patent No.: US 9,744,431 B2
(45) Date of Patent: Aug. 29, 2017

(54) BINDING SYSTEM FOR A TOURING SNOWBOARD

(71) Applicant: FELISAZ SAS, Thiez (FR)

(72) Inventor: Christophe Etallaz, Flaine (FR)

(73) Assignee: FELISAZ SAS, Thiez (FR)

( * ) Notice: Subject to any disclaimer, the term of this patent is extended or adjusted under 35 U.S.C. 154(b) by 274 days.

(21) Appl. No.: 14/432,629

(22) PCT Filed: Oct. 1, 2013

(86) PCT No.: PCT/EP2013/070476
§ 371 (c)(1),
(2) Date: Jul. 16, 2015

(87) PCT Pub. No.: WO2014/053506
PCT Pub. Date: Apr. 10, 2014

(65) Prior Publication Data

US 2016/0129336 A1 May 12, 2016

(30) Foreign Application Priority Data

Oct. 1, 2012 (FR) ..... 12 59284

(51) Int. Cl.
*A63C 5/03* (2006.01)
*A63C 10/00* (2012.01)
(Continued)

(52) U.S. Cl.
CPC ..... *A63C 10/00* (2013.01); *A63C 5/02* (2013.01); *A63C 5/03* (2013.01); *A63C 10/14* (2013.01); *A63C 2203/06* (2013.01)

(58) Field of Classification Search
CPC .. A63C 5/02; A63C 5/03; A63C 10/00; A63C 10/14; A63C 10/16; A63C 10/18; A63C 10/145; A63C 2203/06
See application file for complete search history.

(56) References Cited

U.S. PATENT DOCUMENTS 3,061,325 A * 10/1962 Glass ..... A43B 5/0417 280/613
4,290,213 A * 9/1981 Salomon ..... A43B 5/0415 280/613

(Continued)

FOREIGN PATENT DOCUMENTS

WO WO 01/70349 A2 9/2001
WO WO 2005123202 A2 * 12/2005 ..... A63C 10/04
WO WO 2014/007658 A1 1/2014

OTHER PUBLICATIONS

International Search Report of the ISA for PCT/EP2013/070476 dated Nov. 29, 2013.

(Continued)

*Primary Examiner* — J. Allen Shriver, II
*Assistant Examiner* — Steve Clemmons
(74) *Attorney, Agent, or Firm* — Daly, Crowley, Mofford & Durkee, LLP

(57) ABSTRACT

A binding system includes a base portion shaped to receive a boot. The base portion has first and second opposite facing surfaces. The binding system also includes a first interface having first and second surfaces. The first interface includes two separable interface portions, with each of the two interface portions having first and second opposite facing surfaces and including at least one coupling element disposed over at least the second surface of the interface portion. The at least one coupling element includes a body segment proximate to the second surface of the interface portion and a blocking head segment distal to the second surface of the interface portion. The body segment has a first width with respect to a longitudinal axis of the body segment and the blocking head section having a second, greater width than the first width.

20 Claims, 4 Drawing Sheets

(51) Int. Cl.
*A63C 5/02* (2006.01)
*A63C 10/14* (2012.01)

(56) References Cited

U.S. PATENT DOCUMENTS 5,035,443 A * 7/1991 Kincheloe ..... A63C 10/02 280/14.22
5,505,478 A * 4/1996 Napoliello ..... A63C 10/10 280/14.22
5,984,324 A * 11/1999 Wariakois ..... A63C 5/02 280/14.24
6,056,312 A * 5/2000 Hogstedt ..... A63C 10/06 280/14.24
6,206,402 B1 * 3/2001 Tanaka ..... A63C 10/10 280/14.24
6,308,980 B1 * 10/2001 Karol ..... A43B 5/0401 280/14.22
6,523,851 B1 * 2/2003 Maravetz ..... A63C 5/02 280/14.22
6,773,024 B2 * 8/2004 Walkhoff ..... A63C 7/1053 280/613
7,073,813 B2 * 7/2006 Martin ..... A63C 10/10 280/613
8,276,921 B2 * 10/2012 Walker ..... A63C 9/0802 280/14.24
8,336,903 B2 * 12/2012 Furr ..... A63C 10/12 280/14.24
9,114,305 B2 * 8/2015 Keffler ..... A63C 5/02
2009/0250906 A1 * 10/2009 Ritter ..... A63C 5/02 280/623
2010/0102522 A1 * 4/2010 Kloster ..... A63C 5/02 280/14.24
2012/0274036 A1 * 11/2012 Kloster ..... A63C 5/0411 280/11.31
2015/0014962 A1 * 1/2015 Rayner ..... A63C 10/145 280/611

OTHER PUBLICATIONS

European Office Action and English Translation dated May 4, 2016 for EP Appl. No. 13 71 150.3-1658; 6 pages.

* cited by examiner

BINDING SYSTEM FOR A TOURING SNOWBOARD

CROSS REFERENCE TO RELATED APPLICATIONS

This application is a U.S. National Stage of PCT application PCT/EP2013/070476 filed in the French language on Oct. 1, 2013, and entitled "Binding System for a Touring Snowboard," which claims priority to French application FR1259284 filed Oct. 1, 2012 which application is incorporated herein by reference.

The present invention relates to a system for binding boots on a snowboard, and more particularly on a touring snowboard.

Touring snowboards have the particular feature of comprising two longitudinal sections of board, which, when they are coupled, form a snowboard for descent of snowy slopes. Reference is then made to the descent position of the touring snowboard. When the two longitudinal sections of board are detached, they form two touring skis which make it possible to ascend snowy slopes. In this case, reference is made to the touring position of the touring snowboard.

In general, snowboard boots are bound on a touring snowboard by means of a base which is configured to receive and retain each snowboard boot, for example by means of semi-rigid straps. In particular, the base comprises a binding means, conventionally placed on the toe side of the base, which, in the touring position, makes it possible to bind the snowboard boot on a standard touring binding placed on each longitudinal section of board.

In the descent position, the snowboard boots are bound on the two sections of board simultaneously. Applications U.S. Pat. No. 5,984,324; US 2010/0102522 and WO 01/70349 show different types of base binding on a touring snowboard in the descent position. In particular, these applications show a binding system comprising a first interface which is bound on the snowboard, and comprises two independent half-interfaces which are each bound opposite one another on a section of board. A second interface, which is placed on the base, is bound on the first interface, and forms the connection between the two half-interfaces in the descent position, thus permitting binding of the base on the snowboard, and coupling and retention of the sections of board.

However, the binding systems disclosed in the prior art documents are not satisfactory. In fact, these systems can have removable elements and parts which are difficult to manipulate when wearing ski gloves, and make the transition from one position to another all the more complicated. In addition, they can have restrictive and complicated binding adjustments, in particular with reference to the application of a binding angle relative to the longitudinal axis of the snowboard.

Thus, one of the objectives of the invention is to remedy at least partially the disadvantages of the prior art, and propose a system for binding of boots on a touring snowboard in the descent position, which system is improved and easy to use.

The present invention thus relates to a binding system designed for binding of a boot on a touring snowboard, said snowboard comprising two longitudinal sections of board which are coupled to one another in the descent position, and detached in the touring position, said binding system being configured to be used in the descent position, and comprising:

- a base which is configured to receive and retain a snowboard boot;

- a first interface which is bound on the snowboard, comprising in particular two independent half-interfaces which are each bound opposite one another on a section of board;
- a second interface which is placed connected to the base, is bound on the first interface, and forms the connection between the two half-interfaces in the descent position, such that

- each half-interface comprises at least one coupling element comprising a body surmounted by a blocking head which is wider than said body;
- the second interface comprises at least two openings for receipt and blocking of the coupling elements, said receipt and blocking openings comprising two adjacent portions, a first portion with a width which is sufficient to allow the blocking head to pass through the receipt and blocking opening, and a second portion, with a width smaller than the first portion, which permits passage only of the body;
- the second interface additionally comprises at least one system for locking of at least one coupling element inside its associated receipt and blocking opening.

This configuration of the first and second interfaces permits easy binding and detachment of the base, which does not require any particular tooling, and can be carried out even without removing the boot from said base. In addition, the binding system comprises fewer mobile and exposed parts, and is therefore less susceptible to the snow which could accumulate at the first and second interfaces and could block or prevent the binding.

According to one aspect of the invention, the two half-interfaces each comprise at least one set-back, said at least one set-back, of a half-interface being complementary with the at least one set-back of the other interface, such that in the descent position, said at least one set-backs fit together.

The at least one set-back on each half-interface makes it possible to limit the shearing movements between the sections of board in the descent position, and thus strengthens the touring snowboard in the descent position.

According to another aspect of the invention, the coupling elements have a convergent form which is situated on the same axis, and points in the same direction, and the receipt and blocking openings also have a substantially triangular form.

According to another aspect of the invention, each half-interface comprises a notch in the form of an arc of a circle, said notches in the form of an arc of a circle being concentric, and the coupling elements comprise a means for clamping in said notch in the form of an arc of a circle which, in the released state, allows it to slide along said notch in the form of an arc of a circle, and in the clamped state blocks said coupling element.

According to another aspect of the invention, the locking system comprises at least one locking finger, which is mobile around, an axis between

- a locking position where an end of said locking finger is in contact with a coupling element, such as to block the latter inside its associated receipt and blocking opening at its second portion; and
- an unlocking position where the end of said locking finger is spaced from the coupling element, the latter being able to access the first portion of its associated receipt and blocking opening from the second portion.

According to another aspect of the invention, the at least one locking finger is connected to an unlocking lever which controls its passage from its locking position to its unlocking position.

According to another aspect of the invention, the locking system additionally comprises a resilient element which is connected to at least one locking finger, such that the latter is brought automatically into the locking position.

According to another aspect of the invention, the blocking head of the at least one blocking element, in connection with the at least one locking finger, comprises at least one indent, such that said blocking element can pass through the receipt and blocking opening, whilst the at least one blocking finger is in the locking position.

According to another aspect of the invention, the blocking system comprises two locking fingers which ensure the locking of a single blocking element, their ends which are designed to come into contact with the blocking element being spaced from one another in the unlocking position and brought towards one another in the locking position.

According to another aspect of the invention, the second portion of the receipt and blocking opening is produced by binding a stop on the second interface.

The present invention also relates to a snowboard comprising two longitudinal sections of board which are coupled to one another in the descent position and detached in the touring position, comprising a binding system as previously described for each boot.

The present invention also relates to a binding kit, comprising two binding systems as previously described, and two standard touring ski bindings.

Other characteristics and advantages of the invention will become more apparent from reading the following description provided by way of illustrative and non-limiting example, and from the accompanying drawings, in which.

Figure 3A:
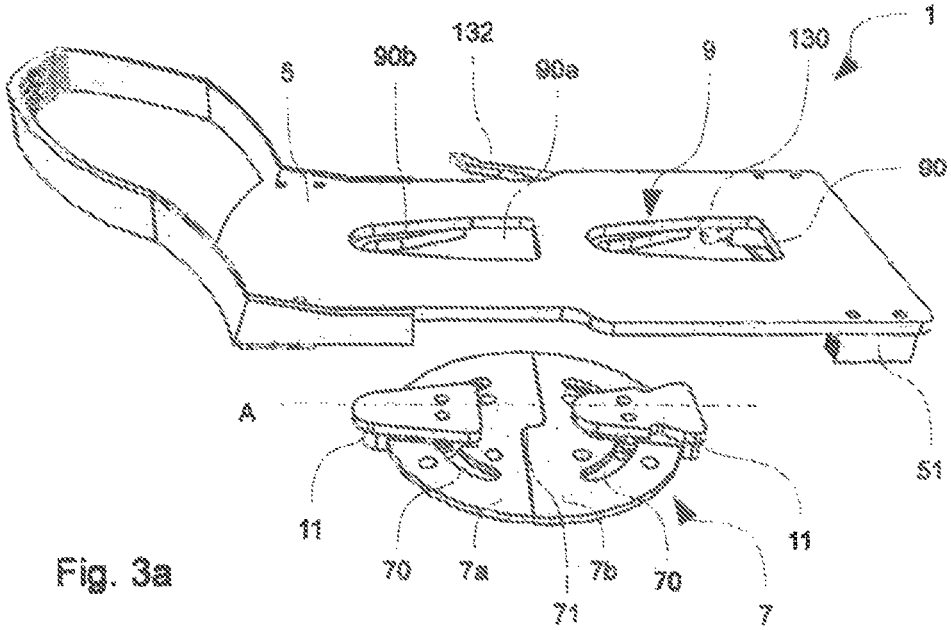
Figure 3B:
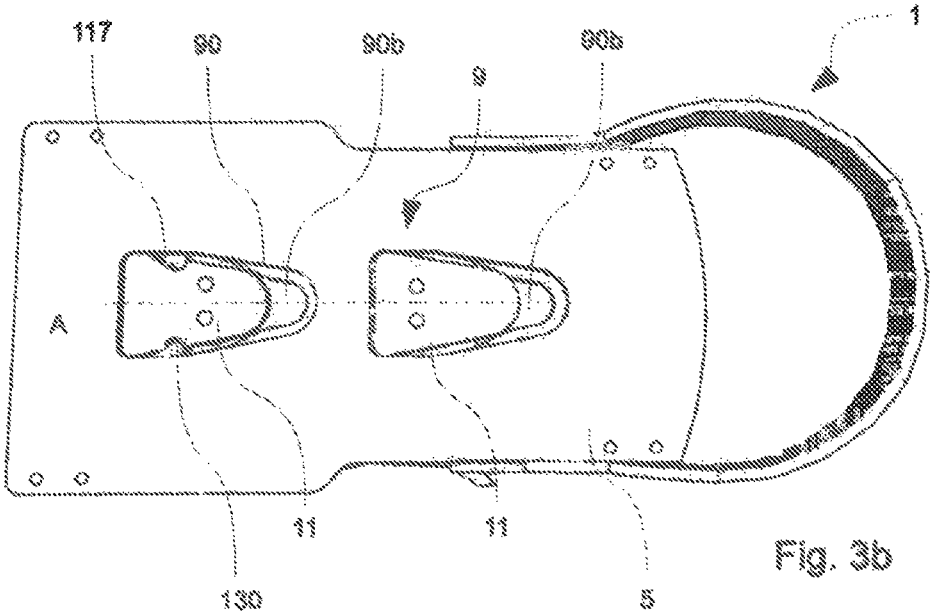
Figure 3C:
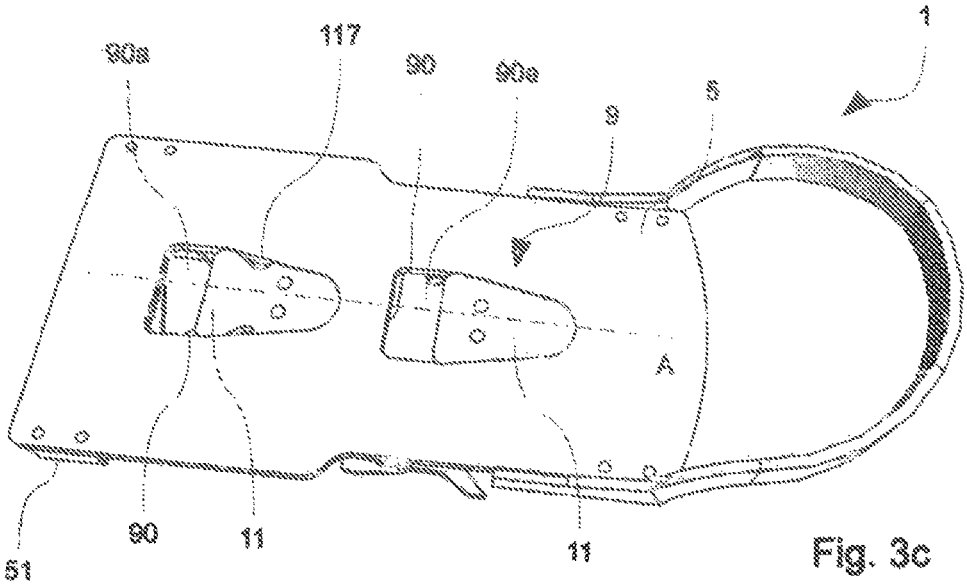
Figure 4:
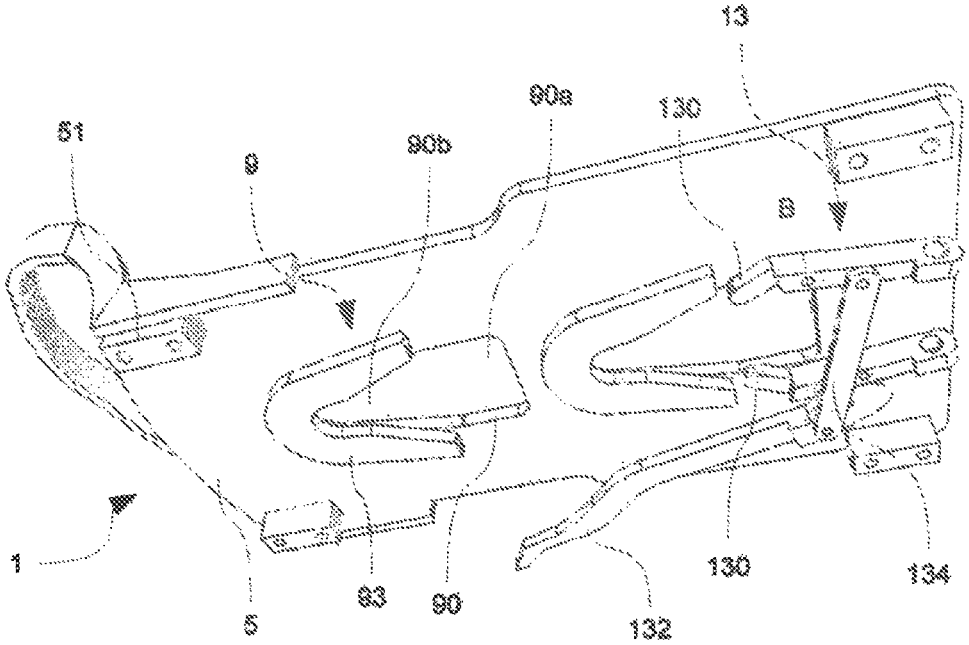
Figure 5:
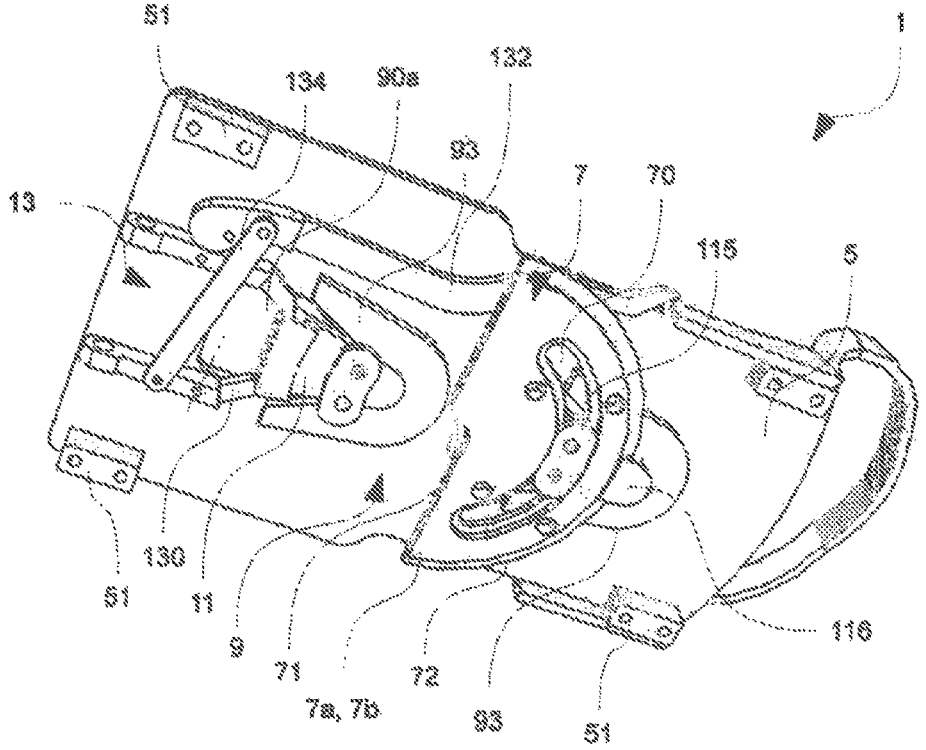

FIGS. 3*a*, 3*b* and 3*c* show a representation in perspective of the first and second interfaces of a binding system according to the invention in the bound and detached states;

FIG. 4 shows a representation in perspective from below of a second interface;

FIG. 5 shows a representation in perspective from below of the binding system in the bound state.

In all the figures, elements which are identical bear the same reference numbers.

Figure 1:
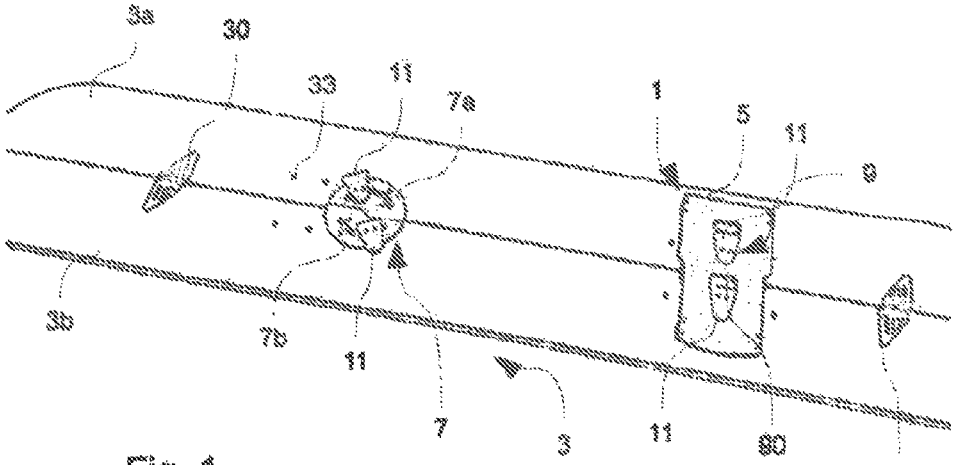
FIG. 1 shows a representation in perspective of a touring snowboard in the descent position.

FIG. 1 thus shows a touring snowboard 3 in the descent position. The touring snowboard 3 comprises two longitudinal sections of board 3*a*, 3*b* which are coupled to one another in the descent position by locking means 30, for example a hook, and two binding systems 1 which are each designed to receive a foot of the user.

In particular, the binding system 1 comprises a base 5 which is configured to receive and retain a snowboard boot, for example by means of straps (not represented).

The binding system 1 also comprises a first interface 7 which is bound on the snowboard 3, comprising in particular two half-interfaces 7*a*, 7*b* which are independent, and are each bound opposite one another on a section of board 3*a*, 3*b*. Each half-interface 7*a*, 7*b* comprises at least one coupling element 11. The half-interfaces 7*a*, 7*b* can be bound by screwing into threaded orifices 30 which are placed in a manner which is conventional in the field of snowboard bindings, thus making it possible to adjust the spacing between the two binding systems.

The binding system 1 additionally comprises a second interface 9 which is connected to the base 5, and is bound on the first interface 7, and forms the connection between the two half-interfaces 7*a*, 7*b* in the descent position. The second interface 9 comprises at least one receipt and blocking opening 90, which, in connection with the at least one coupling element 11, permits the binding of the first interface 7 with the second interface, and consequently the binding of the base 5 with the snowboard 3.

Figure 2:
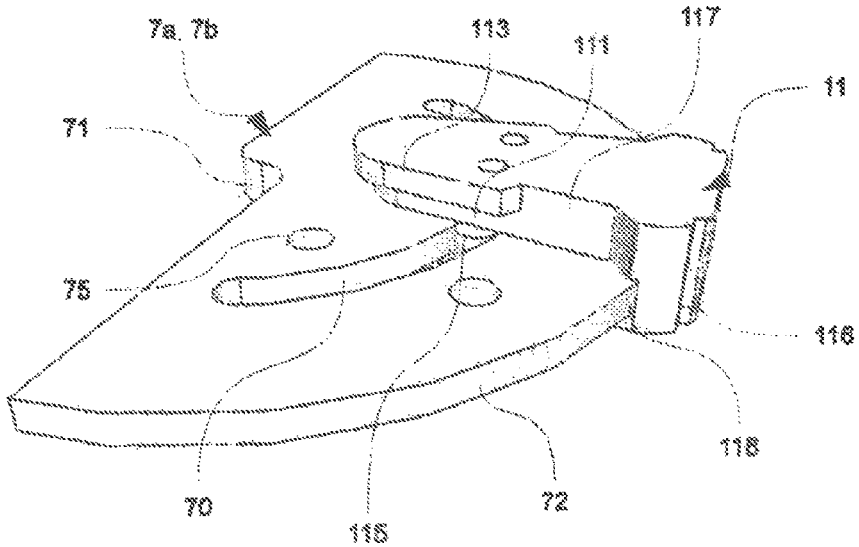
FIG. 2 shows a representation in perspective of a half-interface of the first interface.

FIG. 2 shows in perspective a representation of a half-interface 7*a*, 7*b*. The half-interface 7*a*, 7*b* comprises at least one set-back 71, and said at least one set-back 71 of the half-interface 7*a*, 7*b* is complementary with at least one set-back 71 contained by the other half-interface 7*a*, 7*b*, such that, in the descent position, said at least one set-backs 71 fit together. The at least one set-back 71 is provided on a section of the half-interface 7*a*, 7*b* which is substantially parallel to the longitudinal sides of the snowboard 3.

The at least one set-back 71 on each half-interface 7*a*, 7*b* makes it possible to limit the shearing movements between the sections of board 3*a*, 3*b* in the descent position, and thus strengthens the touring snowboard 3 in the descent position.

The half-interface 7*a*, 7*b* also comprises at least one coupling element 11. Said coupling element 11 comprises a body 111 surmounted by a blocking head 113 which is wider than said body 111. The half-interface 7*a*, 7*b* comprises, preferably four, binding orifices 75, which permit the passage of a binding screw which is screwed into threaded orifices 33 in a section of board 3*a*, 3*b*.

The half-interface 7*a*, 7*b* also comprises at least one notch in the form of an arc of a circle 70, which, in connection with a clamping means 115, permits the connection between a coupling element 11 and said half-interface. Thus, in the released state, the clamping element 115 allows the coupling element 11 to slide along the notch in the form of an arc of a circle 70, and, in the clamped state, it blocks any movement of said, coupling element 11. The clamping element 115 can thus be placed between the half-interface 7*a*, 7*b* and the section of board 3*a*, 3*b* on which it is bound, in a receptacle below the notch in the form of an arc of a circle. The coupling element, for its part, is placed on the half-interface 7*a*, 7*b* and is connected to the clamping element 115, for example by means of one or more screws.

The half-interface 7*a*, 7*b* can be in the form of a semi-circle, which is concentric with the notch in the form of an arc of a circle 70, and can comprise a shoulder 72 on its outer edge. This shoulder 72 can be used as a guide and a second connection point between the half-interface 7*a*, 7*b* and the coupling element 11. The latter can thus comprise an extension 116 comprising a notch 118 in which the shoulder 72 is inserted.

As shown in FIG. 1 and FIG. 3*a*, the two half-interfaces 7*a*, 7*b* are opposite one another in the descent position. The notches in the form of an arc of a circle 70 of each half-interface 7*a*, 7*b* are concentric. The coupling elements 11 can also have a substantially convergent form, for example triangular, situated on the same axis A and pointing in the same direction.

The adjustment of the bonding angle relative to the longitudinal axis of the snowboard can thus be carried out easily by releasing the coupling elements 11, which can thus slide inside their notch in the form of an arc of a circle 70, and by pivoting of the base 5.

FIG. 3*a* also shows the second interface 9 in greater detail. Said second interface, placed on the base 5, comprises at least two openings 90 for receipt and blocking of the coupling elements 11. The receipt and blocking openings 90, which are preferably provided in the base 5, comprise two adjacent portions 90*a*, 90*b*. The first portion has a width which is sufficient to allow the blocking head 113 to pass through the receipt and blocking opening 90. The second portion 90*b*, which has a width smaller than the first portion 90*a*, permits passage only of the body 111 through the receipt and blocking opening 90. In the same way as for the coupling elements 11, the receipt and blocking openings 90 can have a form which is substantially convergent, for example triangular.

As shown in FIGS. 3*a* to 3*c*, which represent the first 7 and second 9 interfaces in the detached state (FIG. 3*a*) and bound state (FIG. 3*b*), these interfaces are bound as follows:

- the base 5 and its second interface 9 are brought above the first interface 7, with the receipt and blocking openings 90 being aligned with the coupling elements 11;
- the base 5 is brought towards the first interface 7, such that the blocking heads 113 of the coupling elements 11 pass through the first portions 90*a* of the receipt and blocking openings 90, as shown in FIG. 3*b;*
- a movement of translation along the axis A is applied to the base 5, such that the bodies 111 of the coupling elements 11 pass into the second portions 90*b* of the receipt and blocking openings 90, thus blocking the blocking heads 113 as shown in FIG. 3*c*.

The base 5 can also comprise wedges 51 which are supported on the touring snowboard in order to stabilize the binding between the first 7 and second 9 interfaces.

As illustrated in FIG. 4 in a view from below, the second portion 90*b* of the receipt and blocking openings 90 can be produced by binding a stop 93 on the second interface 9. In the case when the blocking head 113 of the coupling element has the same height as the thickness of the base 5, and the stop 93 has the same height as that of the body 111, the use of a stop 93 makes it possible to obtain good stability and optimum binding of the interfaces to one another, since the gaps between the interfaces are limited, as well as to obtain a flat base 5.

In order to retain the coupling elements 11 inside the receipt and blocking openings 90, the second interface comprises at least one locking system 13, as illustrated in FIGS. 4 and 5. The locking system 13 comprises at least one locking finger 130, which is mobile around an axis B, between:

- a locking position in which an end of said locking finger 130 is in contact with a coupling element 11, such as to block the latter inside its associated receipt and blocking opening 90 at its second portion 90*b*, as illustrated in FIG. 5; and
- an unlocking position in which the end of said locking finger 130 is spaced from the coupling element 11, the latter being able to access the first portion 90*a* of its associated receipt and blocking opening 90 from the second portion 90*b*.

The at least one locking finger 13 can go from one position to another by means of an unlocking lever 132. Pulling the unlocking lever 132 makes the locking finger 13 pivot around its axis B, such as to make it go into the unlocking position. The locking system can also comprise a resilient element (not represented), for example a spring, which is in connection with the locking finger 13, and returns it automatically to the locking position. Because of the connection between the at least one locking finger and the unlocking lever 132, the resilient element also permits automatic return of the lever.

As shown in FIGS. 2, 3*b* and 3*c*, at least one coupling element 11 can comprise at least one indent 117, such that said blocking element 11 can pass through the receipt and blocking opening 90, whilst the at least one blocking finger 130 is in the locking position.

This configuration of the first 7 and second 9 interfaces permits easy binding and detachment of the base 5, which does not require any particular tooling, and can be carried out even without removing the boot from said base 5. In addition, the binding system 1 comprises fewer mobile and exposed parts, and is therefore less susceptible to the snow which could accumulate at the first 7 and second 9 interfaces and could block or prevent the binding. The locking provided by the resilient element is automatic, which simplifies further still the use of the binding system 1, with the unlocking being carried out simply by pulling the unlocking lever 132.

In the example represented in FIGS. 3*a* to 3*c* and 4, the locking system 13 comprises two locking fingers 130 which ensure the locking of a single blocking element 11. The ends of said locking fingers 13 which are designed to come into contact with the blocking element 11 are spaced from one another in the unlocking position, in order to allow said blocking element 11 to pass, and are brought towards one another in the locking position in order to block the element. The unlocking lever 132 is in direct connection by contact with a first locking finger 130, in order to make it pivot around its axis B, to put it into the unlocking position, and is in connection by means of a connecting rod 134 with the second locking finger 130, such as to make it pivot around its axis B, in a direction opposite that of the first locking finger 130.

The base 5 can also comprise an additional binding system (not represented), which is configured to be used in the touring position. This additional binding system, placed at the front of the base 5, i.e. on the tip of the user's foot side, is designed to come into relation with a standard touring ski binding (not represented), placed on each section of board 3*a*, 3*b*.

The present invention also relates to a binding kit comprising two binding systems 1 as previously described, one per boot, and two standard touring ski bindings.

It is also possible to conceive of an alternative use of the binding system 1 according to the invention, wherein said binding system 1, or more specifically the first interface 7, is connected to a standard snowboard. The user uses the base 5 both to bind himself on the standard snowboard, but also to bind himself on a standard touring ski binding installed on a standard touring ski, in order to undertake an approach trajectory.

Thus, it can be seen clearly that as a result of the configuration of the first 7 and second 9 interfaces, the binding system 1 according to the invention permits simple binding of the sections of boards 3*a*, 3*b* to one another in the descent position, as well as easy unlocking in order to go into the touring position.

The invention claimed is:

1. A binding system for a touring snowboard, the touring snowboard having first and second opposite facing surfaces and including two separable sections with each of the two sections having first and second opposite facing surfaces and at least first and second opposite facing sides, the first surfaces of each of the two sections corresponding to the first surface of the touring snowboard, wherein a first side of a first one of the two sections is coupled to a second side of a second one of the two sections in a first, descent position, and the first side of the first one of the two sections is detached from the second side of the second one of the two sections in a second, touring position, the binding system configured to couple the two sections of the touring snowboard together and receive and couple a boot to the touring snowboard in the first position, and the binding system comprising:

a base portion shaped to receive a boot, said base portion having first and second opposite facing surfaces;

a first interface having first and second surfaces, said first interface including:

two separable interface portions, with each of the two interface portions having first and second opposite facing surfaces and including:

at least one coupling element disposed over at least the second surface of the interface portion, the at least one coupling element including:

a body segment proximate to the second surface of the interface portion and a blocking head segment distal to the second surface of the interface portion, the body segment having a first width with respect to a longitudinal axis of the body segment and the blocking head section having a second, greater width than the first width; and a second interface for coupling the base portion to the first interface, said second interface having first and second opposite facing surfaces, wherein the first surface of the base portion is disposed over the second surface of the second interface, the second interface including:

at least two openings for receiving and removably coupling the at least one coupling element of each of the two interface portions of the first interface to the second interface, each of the at least two openings extending between the first and second surfaces of the second interface and including:

a first portion having dimensions which are sufficient to receive the blocking head segment of the at least one coupling element of a corresponding one of the two interface portions; and a second portion which is adjacent to the first portion, the second portion having dimensions which are sufficient to receive the body segment of the at least one coupling element of the corresponding one of the two interface portions; and a coupling system for coupling the at least one coupling element of each of the two interface portions of the first interface inside a corresponding opening of the at least two opening such that the two interface portions are coupled together and the second interface is coupled to the first interface.

2. The binding system as claimed in claim 1 wherein the two interface portions each comprise at least one set-back, wherein the at least one set-back of a first one of the two interface portions has a surface which is complementary with a surface of the at least one set-back of a second one of the two interface portions such that in the first position of the touring snowboard the at least one set-backs of the first and second ones of the two interface portions fit together.

3. The binding system as claimed in claim 2 wherein the coupling system of the second interface comprises at least one locking finger which is mobile around an axis between:

a locking position where an end of the at least one locking finger is in contact with a corresponding coupling element of the at least one coupling element such as to block the coupling element inside a corresponding opening of the at least two openings in the second portion; and an unlocking position where the end of the at least one locking finger is spaced apart from the coupling element, the coupling element being able to access the first portion of the opening from the second portion.

4. The binding system as claimed in claim 3 wherein the at least one locking finger is coupled to an unlocking lever which controls passage of the at least one locking finger from the locking position to the unlocking position.

5. The binding system as claimed in claim 3 wherein the locking system further comprises:

a resilient element coupled to select portions of the at least one locking finger such that the at least one locking finger is brought into the locking position through use of the resilient element.

6. The binding system as claimed in claim 3 wherein the blocking head segment of the at least one coupling element, in connection with the at least one locking finger of the second interface, comprises:

at least one indent in a surface of at least one of the blocking head segment and the at least one locking finger such that the blocking head segment can pass through the corresponding opening when the at least one locking finger is in the locking position.

7. The binding system as claimed in claim 3 wherein the coupling system comprises two locking fingers which ensure locking of at least a single coupling element of the at least one coupling element, the two locking fingers having ends which come into contact with the coupling element, wherein the locking fingers are spaced apart from the coupling element in the unlocking position and brought towards the coupling element in the locking position.

8. The binding system as claimed in claim 1 wherein the at least one coupling element of each interface portion of the first interface and the at least two openings in the second interface have a substantially convergent form.

9. The binding system as claimed in claim 1 wherein each interface portion of the first interface comprises a notch in select portions of the second surface of the interface portion, the notch having a form of an arc of a circle and being concentric, and the at least one coupling element of each interface portion comprising a means for movably coupling to the notch such that in a released state the means for movably coupling to the notch moves along the notch in the form of an arc of a circle, and in a clamped state the means for movably coupling to the notch resists motion of the at least one coupling element.

10. The binding system as claimed in claim 1 wherein the second portion of the at least two openings is produced by coupling a motion resistive element on a corresponding surface of the second interface.

11. A snowboard having first and second opposite facing surfaces, the snowboard comprising:

two separable sections with each of the two sections having first and second opposite facing surfaces and at least first and second opposite facing sides, the first surfaces of each of the two sections corresponding to the first surface of the snowboard, wherein a first side of a first one of the two sections is coupled to a second one of the two sections in a first, descent position, and the first side of the first one of the two sections is detached from the second side of the second one of the two sections in a second, touring position; and two binding systems, each of the two binding systems configured to receive and couple a boot to the first surface of the snowboard in the first position, and each of the two binding systems comprising:

a base portion shaped to receive a boot, said base portion having first and second opposite facing surfaces;

a first interface having first and second surfaces, said first interface including:

two separable interface portions, with each of the two interface portions having first and second opposite facing surfaces and including:

at least one coupling element disposed over at least the second surface of the interface portion, the at least one coupling element including:

a body segment proximate to the second surface of the interface portion and a blocking head segment distal to the second surface of the interface portion, the body segment having a first width with respect to a longitudinal axis of the body segment and the blocking head section having a second, greater width than the first width; and a second interface for coupling the base portion to the first interface, said second interface having first and second opposite facing surfaces, wherein the first surface of the base portion is disposed over the second surface of the second interface, the second interface including:

at least two openings for receiving and removably coupling the at least one coupling element of each of the two interface portions of the first interface to the second interface, each of the at least two openings extending between the first and second surfaces of the second interface and including:

a first portion having dimensions which are sufficient to receive the blocking head segment of the at least one coupling element of a corresponding one of the two interface portions; and a second portion which is adjacent to the first portion, the second portion having dimensions which are sufficient to receive the body segment of the at least one coupling element of the corresponding one of the two interface portions; and a coupling system for coupling the at least one coupling element of each of the two interface portions of the first interface inside a corresponding opening of the at least two openings such that the two interface portions are coupled together, the second interface is coupled to the first interface, and the two sections of the snowboard are coupled together.

12. The snowboard as claimed in claim 11 wherein the two interface portions of the first interface of each of the two binding systems each comprise at least one set-back, wherein the at least one set-back of a first one of the two interface portions has a surface which is complementary with a surface of the at least one set-back of a second one of the two interface portions such that in the first position of the touring snowboard the at least one set-backs of the first and second ones of the two interface portions fit together.

13. The snowboard as claimed in claim 12 wherein the coupling system of the second interface of each of the two binding systems comprises at least one locking finger which is mobile around an axis between:

a locking position where an end of the at least one locking finger is in contact with a corresponding coupling element of the at least one coupling element such as to block the coupling element inside a corresponding opening of the at least two openings in the second portion; and an unlocking position where the end of the at least one locking finger is spaced apart from the coupling element, the coupling element being able to access the first portion of the opening from the second portion.

14. The snowboard as claimed in claim 13 wherein the at least one locking finger is coupled to an unlocking lever which controls passage of the at least one locking finger from the locking position to the unlocking position.

15. The snowboard as claimed in claim 13 wherein the locking system further comprises:

a resilient element coupled to select portions of the at least one locking finger such that the at least one locking finger is brought into the locking position through use of the resilient element.

16. In a system including a touring snowboard and a binding kit for the touring snowboard, the touring snowboard having first and second opposite facing surfaces and including two separable sections with each of the two sections having first and second opposite facing surfaces and at least first and second opposite facing sides, the first surfaces of each of the two sections corresponding to the first surface of the touring snowboard, wherein a first side of a first one of the two sections is coupled to a second side of a second one of the two sections in a first, descent position, and the first side of the first one of the two sections is detached from the second side of the second one of the two sections in a second, touring position; and the binding kit including a first binding set for the touring snowboard in the first position and a second binding set for the touring snowboard in the second position, the first binding set comprising:

two binding systems, each of the two binding systems configured to couple the two sections of the touring snowboard together and receive and couple a boot to the touring snowboard in the first position, and each of the two binding systems comprising:

a base portion shaped to receive a boot, said base portion having first and second opposite facing surfaces;

a first interface having first and second surfaces, said first interface including:

two separable interface portions, with each of the two interface portions having first and second opposite facing surfaces and including:

at least one coupling element disposed over at least the second surface of the interface portion, the at least one coupling element including:

a body segment proximate to the second surface of the interface portion and a blocking head segment distal to the second surface of the interface portion, the body segment having a first width with respect to a longitudinal axis of the body segment and the blocking head section having a second, greater width than the first width; and a second interface for coupling the base portion to the first interface, said second interface having first and second opposite facing surfaces, wherein the first surface of the base portion is disposed over the second surface of the second interface, the second interface including:

at least two openings for receiving and removably coupling the at least one coupling element of each of the two interface portions of the first interface to the second interface, each of the at least two openings extending between the first and second surfaces of the second interface and including:

a first portion having dimensions which are sufficient to receive the blocking head segment of the at least one coupling element of a corresponding one of the two interface portions; and a second portion which is adjacent to the first portion, the second portion having dimensions which are sufficient to receive the body segment of the at least one coupling element of the corresponding one of the two interface portions; and a coupling system for coupling the at least one coupling element of each of the two interface portions of the first interface inside a corresponding opening of the at least two opening such that the two interface portions are coupled together and the second interface is coupled to the first interface.

17. The first binding set as claimed in claim 16 wherein the two interface portions of the first interface of each of the two binding systems each comprise at least one set-back, wherein the at least one set-back of a first one of the two interface portions has a surface which is complementary with a surface of the at least one set-back of a second one of the two interface portions such that in the first position of the touring snowboard the at least one set-backs of the first and second ones of the two interface portions fit together.

18. The first binding set as claimed in claim 17 wherein the coupling system of the second interface of each of the two binding systems comprises at least one locking finger which is mobile around an axis between:

a locking position where an end of the at least one locking finger is in contact with a corresponding coupling element of the at least one coupling element such as to block the coupling element inside a corresponding opening of the at least two openings in the second portion; and an unlocking position where the end of the at least one locking finger is spaced apart from the coupling element, the coupling element being able to access the first portion of the opening from the second portion.

19. The first binding set as claimed in claim 18 wherein the at least one locking finger is coupled to an unlocking lever which controls passage of the at least one locking finger from the locking position to the unlocking position.

20. The first binding set as claimed in claim 18 wherein the locking system further comprises:

a resilient element coupled to select portions of the at least one locking finger such that the at least one locking finger is brought into the locking position through use of the resilient element.

* * * * *